US012673748B2

(12) United States Patent
Sun et al.

(10) Patent No.: US 12,673,748 B2
(45) Date of Patent: Jul. 7, 2026

(54) ADJUSTABLE CAVITATOR STRUCTURE HAVING DOUBLE LAYER RETRACTABLE SHEET

(71) Applicant: DALIAN UNIVERSITY OF TECHNOLOGY, Dalian (CN)

(72) Inventors: Tiezhi Sun, Dalian (CN); Yao Li, Dalian (CN); Zhi Zong, Dalian (CN)

(73) Assignee: DALIAN UNIVERSITY OF TECHNOLOGY, Dalian (CN)

( * ) Notice: Subject to any disclaimer, the term of this patent is extended or adjusted under 35 U.S.C. 154(b) by 463 days.

(21) Appl. No.: 18/550,559

(22) PCT Filed: Oct. 27, 2022

(86) PCT No.: PCT/CN2022/127981
§ 371 (c)(1),
(2) Date: Sep. 14, 2023

(87) PCT Pub. No.: WO2023/072201
PCT Pub. Date: May 4, 2023

(65) Prior Publication Data

US 2024/0149980 A1 May 9, 2024

(30) Foreign Application Priority Data

Oct. 29, 2021 (CN) ..... 202111272570.2

(51) Int. Cl.
*B63B 1/38* (2006.01)

(52) U.S. Cl.
CPC ..... *B63B 1/38* (2013.01); *B63B 2001/382* (2013.01)

(58) Field of Classification Search
CPC ..... B63B 1/00; B63B 1/38; B63B 2001/382
USPC ..... 114/312
See application file for complete search history.

(56) References Cited

U.S. PATENT DOCUMENTS

| | | | |
|---|---|---|---|
| 5,738,034 | A | 4/1998 | Wolff et al. |
| 2010/0071605 | A1 | 3/2010 | Kuklinski |

FOREIGN PATENT DOCUMENTS

| | | | |
|---|---|---|---|
| CN | 105352704 | A | 2/2016 |
| CN | 105620652 | A | 6/2016 |
| CN | 205442715 | U | 8/2016 |
| CN | 110758695 | A | 2/2020 |
| CN | 112413038 | A | 2/2021 |
| CN | 112413039 | A | 2/2021 |
| CN | 112413040 | A | 2/2021 |
| CN | 113879449 | A | 1/2022 |
| WO | 2016204348 | A1 | 12/2016 |

*Primary Examiner* — Lars A Olson
(74) *Attorney, Agent, or Firm* — NKL Law; Allen Xue

(57) ABSTRACT

An adjustable cavitator structure has a cavitator disposed at a head end of the underwater vehicle. The cavitator has a cavitator body, a center of which is connected to the head center of the underwater vehicle through a damper. The front end of the cavitator body is detachably connected with a head fairing device. The cavitator body is of a double-layer structure including a first layer and a second layer. A plurality of cavitator disc face retractable sheets are installed on the first layer and the second layer and are evenly distributed around the axis of the cavitator body, and are slidably connected with the corresponding first layer or second layer. A buffer driving mechanism for driving the cavitator disc face retractable sheets to slide in a radial direction of the cavitator body is installed at the head end of the underwater vehicle.

9 Claims, 12 Drawing Sheets

ADJUSTABLE CAVITATOR STRUCTURE HAVING DOUBLE LAYER RETRACTABLE SHEET

TECHNICAL FIELD

The present invention relates to the technical field of vehicle water-entry, in particular to an adjustable cavitator structure having double layer retractable sheets.

BACKGROUND

Underwater supercavity vehicle and underwater weapon mainly rely on generating supercavity to completely wrap their body so as to achieve the purpose of reducing the navigation resistance thereof. However, at present, a fixed cavitator device is designed for most of underwater vehicles, and generating supercavity depends on the fixed diameter of the cavitator disc face, which cannot be flexibly adjust the size of the generated supercavity according to actual situations. For example, when the navigation speed of the underwater vehicle decreases significantly due to fuel depletion, the size of the supercavity generated by the cavitator will decrease significantly. If the diameter of the original cavitator disc face is smaller, the supercavity generated by the cavitator may be insufficient to completely wrap the underwater vehicle, resulting in an increase in navigation resistance. If the diameter of the original cavitator is too large, it will result in an excessive navigation resistance (the cavitator is a plane, and the larger the area is, the larger the resistance is). In this regard, designing a cavitator capable of flexibly adjusting and generating supercavity becomes a new subject. The adjustment of the cavitation process can greatly improve the adaptability and survivability of the underwater vehicle and increase the voyage, which has a high military value.

Meanwhile, most of the existing underwater vehicles are subjected to a single damping load reduction by using a damper in the water-entry process, which has limited load reduction capability and is not conducive to protecting the underwater vehicle.

SUMMARY OF THE INVENTION

According to the above technical problems, the present invention provides an adjustable cavitator structure having double layer retractable sheets.

The present invention uses technical solutions as follows:

An adjustable cavitator structure having double layer retractable sheets includes a cavitator disposed at a head of an underwater vehicle. The cavitator includes a cavitator body. A center of the cavitator body is connected to a center of the head of the underwater vehicle by means of a damper, and a head fairing device is detachably connected to a front end of the cavitator body. The cavitator body is of a double-layer structure including a first layer and a second layer. Each of the first layer and the second layer is provided with a plurality of cavitator disc face retractable sheets which are uniformly distributed around an axis of the cavitator body and are slidably connected to the corresponding first layer or second layer. The head of the underwater vehicle is provided with a buffer driving mechanism that drives the cavitator disc face retractable sheets to slide in a radial direction of the cavitator body, and the plurality of cavitator disc face retractable sheets and the cavitator body are spliced into a circle.

Further, each of the cavitator disc face retractable sheets is fan-shaped and is provided with a groove accommodating the first layer or the second layer. Sliding U-shaped limiting slots extending in a radial direction are machined on each of the first layer and the second layer, and sliding limiting protrusions matched with the sliding U-shaped limiting slots are machined on each of the cavitator disc face retractable sheets. The plurality of cavitator disc face retractable sheets arranged on the first layer are staggered with the plurality of cavitator disc face retractable sheets arranged on the second layer.

Further, the buffer driving mechanism includes a plurality of airfoil adjusting sheets. A number of the airfoil adjusting sheets is matched with a number of the cavitator disc face retractable sheets, and the airfoil adjusting sheets are uniformly distributed around the axis of the cavitator body. Each the airfoil adjusting sheet corresponds to one cavitator disc face retractable sheet. A rear end of each the airfoil adjusting sheet is hinged with an outer edge of the head of the underwater vehicle. A side of each the airfoil adjusting sheet close to its rear end is hinged with one end of a first buffer retractable arm and a side of that close to its front end is hinged with one end of a second buffer retractable arm. The other end of the first buffer retractable arm is hinged with a front end face of the head of the underwater vehicle, and the other end of the second buffer retractable arm is fixedly connected to an upper part of a corresponding cavitator disc face retractable sheet thereof. A cross section of each the airfoil adjusting sheet is airfoil shape, and two adjacent airfoil adjusting sheets are closely attached.

Further, each the airfoil adjusting sheet is inside provided with a gas acceleration hole which is Tesla valve hole. A front end of the gas acceleration hole is communicated with a third jet port disposed at a front end of the airfoil adjusting sheet, and a rear end of the gas acceleration hole is communicated with a gas storage disposed in the underwater vehicle by means of a hose and a third vent valve.

Further, a booster engine is disposed at a tail of the underwater vehicle, and a tail gas collection device is disposed in the underwater vehicle. The tail gas collection device includes a turbo-inspiratory driving device. One end of the turbo-inspiratory driving device is communicated with an exhaust end of the booster engine by means of a pipeline and the other end of that is communicated with an inlet of the gas storage.

Further, a front center of the cavitator body is provided with a first jet port. The gas storage is communicated with the first jet port by means of a first vent pipeline system.

Further, the damper includes a first outer sleeve which is provided with an oil storage chamber and a first piston rod inside. A front end of the first piston rod penetrates out of the first outer sleeve and is fixedly connected to the cavitator body, a rear end of the first piston rod is provided with a first piston. A part between the first piston and the front end of the first outer sleeve is provided with a tension spring sleeved on the first piston rod. A rear end of the first outer sleeve is fixedly connected to the head of the underwater vehicle, and a part between the rear end of the first outer sleeve and the first piston forms a first hydraulic oil chamber which is communicated with the oil storage chamber.

Further, the first vent pipeline system includes a first vent pipe. A rear end of the first vent pipe is communicated with the gas storage; a first vent valve is disposed in the first vent pipe; and a front end of the first vent pipe successively passes through a rear end center of the first outer sleeve and a center of the first piston, penetrates into the first piston rod, and is in airtight sliding connection with inner walls of the first piston rod and the first piston. An inside of a third piston rod close to its front end is provided with a buffer gas chamber. A rear end of the buffer gas chamber is communicated with the front end of the first vent pipe, and the buffer as chamber is inside provided with a first pressure spring with an axis coinciding with an axis of the first piston rod. An end face of the first vent pipe abuts against the first pressure spring. A front end of the first piston rod is provided with a through hole communicated with the buffer gas chamber, and a front end of the through hole is communicated to the first jet port.

Further, the head fairing device includes a head fairing and a connecting device. The head fairing is detachably connected to a front end of the connecting device. A rear end of the connecting device is detachably connected to the center of the cavitator body, and a head end of the connecting device is provided with a second jet port communicated with the first jet port.

Further, the connecting device includes a connecting pipe fixed at a front end of the first jet port. Two bolt mounting holes are symmetrically machined in a middle of the connecting pipe up and down. Each of the two bolt mounting holes is mounted with a trapezoid fixing bolts, and the two trapezoid fixing bolts are connected with each other by means of a second pressing spring. A side of the trapezoid fixing bolt close to an axis of the connecting pipe is fixed with an electromagnet.

A rear end of a fairing fixing rod is provided with a connecting groove matched with the connecting pipe, and a slot matched with the trapezoid fixing bolt is machined on a wall of the connecting groove.

A front end of the fairing fixing rod is fixed with a connecting piece which is fixedly connected to an inner wall of a rear end of the head fairing.

The faring fixing rod is provided with a second vent pipe inside. A second ventage is disposed at the front end of the fairing fixing rod. A front end of the second vent pipe is communicated with the second ventage and a rear end of the second vent pipe is communicated with the connecting groove.

Compared with the prior art, the present invention has the following beneficial effects:

1. Under the action of the first buffer retractable arm and the second buffer retractable arm, the cavitator disc face retractable sheets in the present invention can achieve expansion and contraction, so that the size of the outer diameter of the cavitator composed of the cavitator body and the cavitator disc face retractable sheets is adjusted. The present invention can adjust the effective area of the cavitator as needed. The larger the size of the cavitator is, the diameter of the generated supercavity is larger, which can maintain the underwater vehicle completely wrapped by the supercavity in real-time under the water and reduce the navigation resistance thereof.

2. The cavitator body adopted in the present invention is of a double-layer structure, each layer is provided with a plurality of cavitator disc face retractable sheets, and a complete circle can be formed when the cavitator disc face retractable sheets extend out.

3. The present invention adopts multi-stage load reduction. Before entering water, the second jet port performs jet load reduction, the third jet port performs jet load reduction and the first jet port performs jet load reduction. During the water-entry process, the first buffer retractable arm and the second buffer retractable arm can play a role in damping load reduction, and the damper also plays a role in damping load reduction.

4. The air injection of the third jet port facilitates the formation of a larger supercavity.

5. The gas acceleration hole of the present invention is of a Tesla valve hole structure, which can perform automatic acceleration after gas enters. The Tesla valve hole is a repetitive chain structure. The more the structure is repeated, the better the acceleration effect is. That is to say, the smaller the repeated single structure size is, the better the pressure reduction effect is. By using the directional function of gas acceleration of the Tesla valve hole, acceleration can be achieved without consuming energy.

Based on the above reasons, the present invention can be widely popularized in the field of water-entry of underwater vehicles and the like.

DETAILED DESCRIPTION OF DRAWINGS

In order to explain technical solutions of embodiments of the present invention or the prior art more clearly, the drawings that need to be used in the embodiments or the prior art will be briefly introduced below. Apparently, the drawings introduced below are only some embodiments of the present invention, and for those ordinarily skilled in the art, other drawings can also be obtained according to these drawings without creative efforts.

Figure 1:
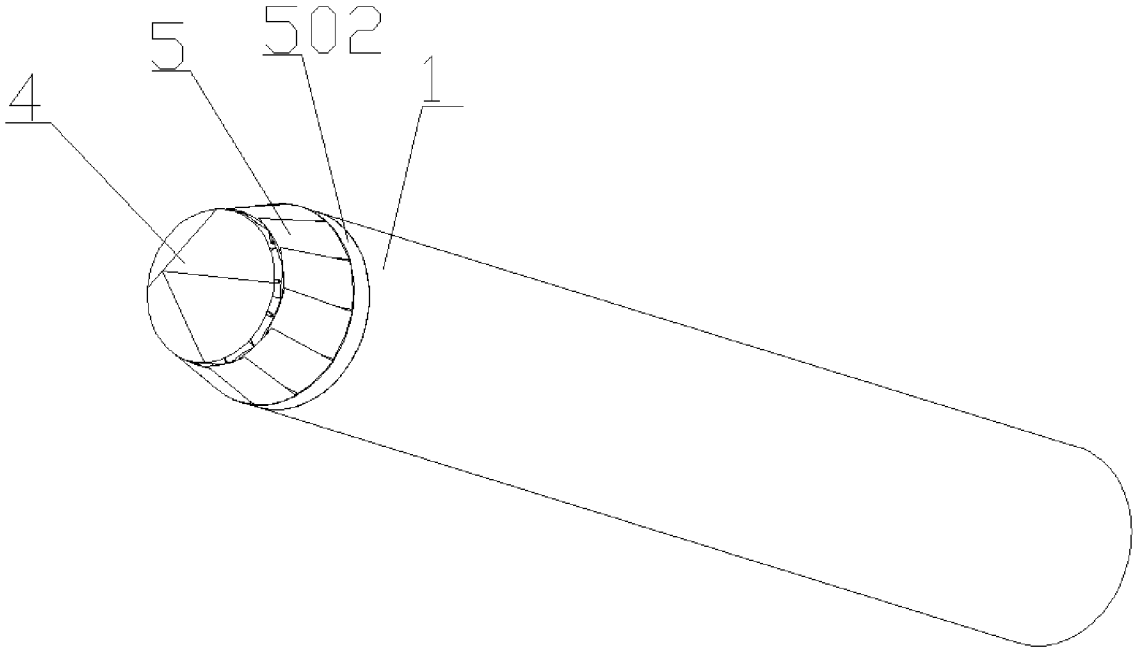
FIG. 1 is a three-dimensional view of a modulated cavitator structure having double layer retractable sheets according to an embodiment of the present invention.
Figure 2:
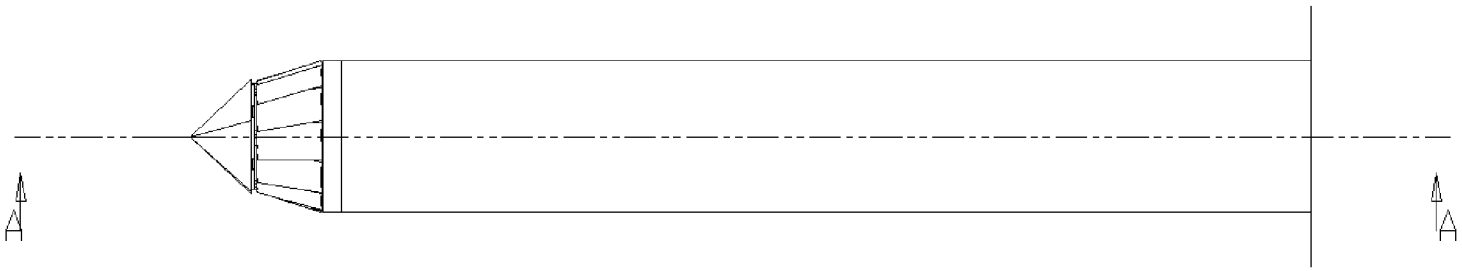
FIG. 2 is a front view of a modulated cavitator structure having double layer telescopic sheets according to an embodiment of the present invention.
Figure 3:
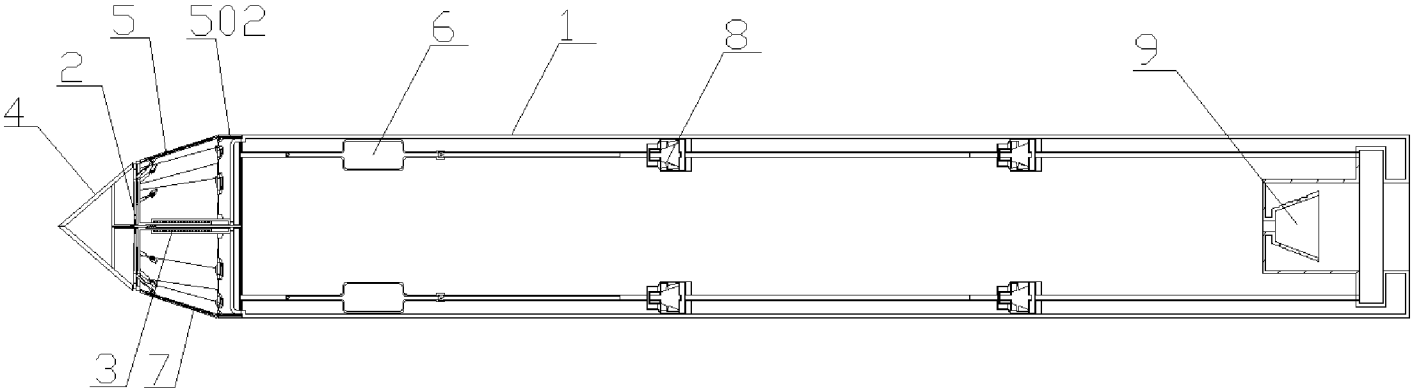
FIG. 3 is an A-A sectional view in the FIG. 2.

In the figures: 1. underwater vehicle, 2. cavitator, 201. cavitator body, 202. cavitator disc face retractable sheet, 203. groove; 204. sliding U-shaped limiting slot; 205. sliding limiting protrusion, 3. damper, 301. oil storage chamber, 302. first outer sleeve, 303. first piston rod, 304. first piston, 305. tension spring, 306. first hydraulic oil chamber; 4. head fairing device, 401. head fairing, 402. second jet port, 403. connecting pipe, 404. trapezoid fixing bolt, 405. second pressure spring, 406. electromagnet, 407. faring fixing rod, 408. connecting groove, 409. slot, 410. connecting piece, 411. second vent pipe, 5. buffer driving device, 501. airfoil adjusting sheet, 502. side fairing, 503. first buffer retractable arm, 504. second buffer retractable arm, 505. second outer sleeve, 506. second piston rod, 507. second piston, 508. third pressure spring, 509. second hydraulic oil chamber, 6. gas storage, 601. first jet port, 602. first vent pipe, 603. first vent valve, 604. first pressure spring, 605. through hole, 7. gas acceleration hole, 701. third jet port, 702. hose, 703. third vent valve, 8 tail gas collection device, 801. turbo-inspiratory driving device, 802. second vent valve, 803. collecting pipeline, 804. turbo-inspiratory device protective cover, 9. booster engine.

DETAILED DESCRIPTION OF PREFERRED EMBODIMENTS

It should be noted that, in the case of no conflicts, the embodiments and the features in the embodiments of the present invention can be combined mutually. The present invention will be described in detail below with reference to the accompanying drawings and the embodiments.

To make the objectives, technical solutions, and advantages of the present invention clearer, the following clearly and completely describes the technical solutions in the embodiments of the present invention with reference to the accompanying drawings in the embodiments of the present invention. Apparently, the described embodiments are merely some rather than all of the embodiments. The following description of at least one exemplary embodiment is actually only illustrative, and in no way serves as any limitation on the present invention and its application or use. Based on the embodiments of the present invention, all the other embodiments obtained by those of ordinary skill in the art without inventive effort are within the protection scope of the present invention.

It should be noted that the terms used herein are only intended to describe specific embodiments and are not intended to limit the exemplary embodiments of the present invention. As used herein, unless indicated obviously in the context, a singular form is intended to include a plural form. Furthermore, it should be further understood that the terms "include" and/or "comprise" used in this specification specify the presence of features, steps, operations, devices, components and/or of combinations thereof.

Unless specifically stated otherwise, the relative arrangement of components and steps, numerical expressions, and numerical values set forth in these embodiments do not limit the scope of the present invention. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely being exemplary rather than limiting. Therefore, other examples of the exemplary embodiment may have different values. It should be noted that similar reference signs and letters represent similar items in the accompanying drawings below. Therefore, once an item is defined in one accompanying drawing, the item does not need to be further discussed in a subsequent accompanying drawing.

In the description of the present invention, it should be noted that orientations or position relationships indicated by orientation terms "front, rear, upper, lower, left, and right", "transverse, vertical, perpendicular, and horizontal", "top and bottom", and the like are usually based on orientations or position relationships shown in the accompanying drawings, and these terms are only used to facilitate description of the present invention and simplification of the description. In the absence of description to the contrary, these orientation terms do not indicate or imply that the apparatus or element referred to must have a specific orientation or be constructed and operated in a specific orientation, and therefore cannot be understood as a limitation on the protection scope of the present invention: orientation words "inner and outer" refer to the inside and outside relative to the contour of each component.

For ease of description, spatially relative terms such as "on", "over", "on the upper surface", and "above" can be used here to describe a spatial positional relationship between one device or feature and another device or feature shown in the figures. It should be understood that the spatially relative terms are intended to include different orientations in use or operation other than the orientation of the device described in the figure. For example, if the device in the figure is inverted, the device described as "above another device or structure" or "on another device or structure" is then be positioned as being "below another device or structure" or "beneath a device or structure". Therefore, the exemplary term "above" can include both orientations "above" and "below". The device can also be positioned in other different ways (rotating by 90 degrees or in another orientation), and the spatially relative description used herein is explained accordingly.

In addition, it should be noted that using terms such as "first" and "second" to define components is only for the convenience of distinguishing the corresponding components. Unless otherwise stated, the foregoing words have no special meaning and therefore cannot be understood as a limitation on the protection scope of the present invention.

Figure 4:
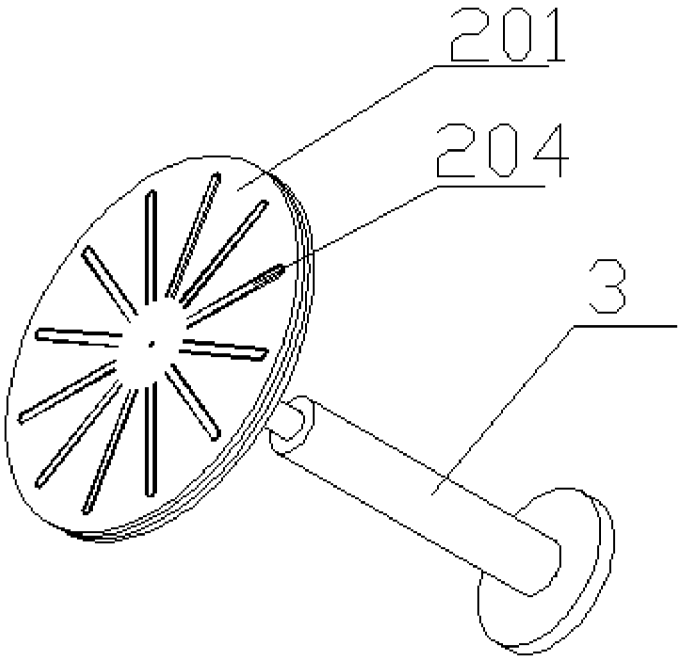
FIG. 4 is a structural schematic diagram of a cavitator main body according to an embodiment of the present invention.
Figure 5:
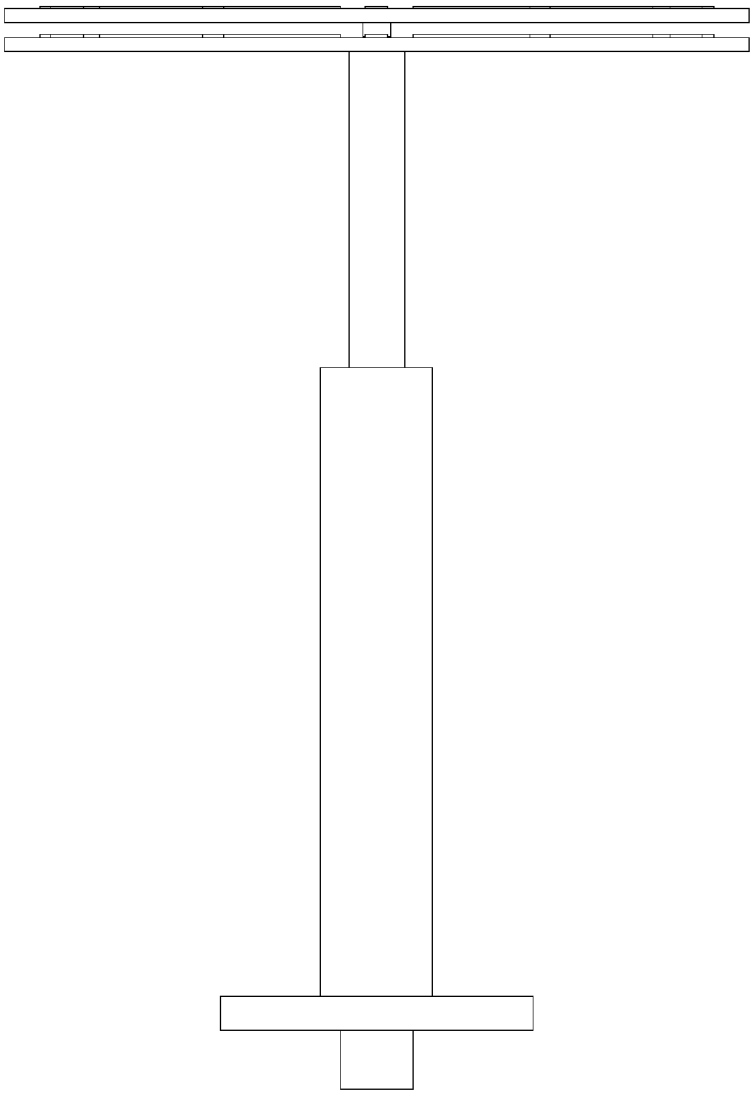
FIG. 5 is a side view of a cavitator body according to an embodiment of the present invention.

As shown in FIGS. 1 to 20, an adjustable cavitator structure having double layer retractable sheets includes a cavitator 2 disposed at a head end of an underwater vehicle 1. The cavitator 2 includes a cavitator body 201. A center of the cavitator body 201 is connected to a center of the head of the underwater vehicle 1 by means of a damper 3, and a head fairing device 4 is detachably connected to a front end of the cavitator body 201. The cavitator body 201 is of a double-layer structure including a first layer and a second layer (as shown in FIG. 5). Each of the first layer and the second layer is provided with a plurality of cavitator disc face retractable sheets 202 which are uniformly distributed around an axis of the cavitator body 201 and are slidably connected to the corresponding first layer or second layer. The head end of the underwater vehicle 1 is provided with a buffer driving mechanism 5 that drives the cavitator disc face retractable sheet 202 to slide in a radial direction of the cavitator body 201, and the plurality of cavitator disc face retractable sheets 202 and the cavitator body 201 are spliced into a circle (as shown in FIGS. 7 and 8).

Figure 6:
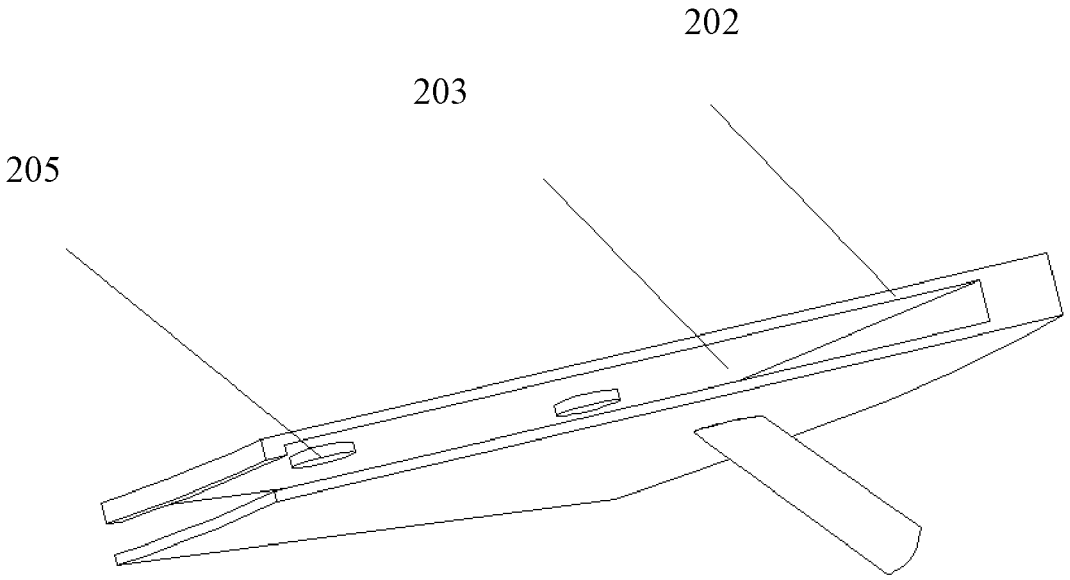
FIG. 6 is a structural schematic diagram of a cavitator disc face retractable sheet according to an embodiment of the present invention.

Each the cavitator disc face retractable sheet 202 is fan-shaped and is provided with a groove 203 (as shown in FIG. 6) accommodating the first layer or the second layer (that is, the first layer or the second layer is inserted into the groove 203). Sliding U-shaped limiting slots 204 extending in the radial direction are machined on each of the first layer and the second layer (as shown in FIG. 4), and sliding limiting protrusions 205 matched with the sliding U-shaped limiting slots 204 are machined on each the cavitator disc face retractable sheet 202. The plurality of cavitator disc face retractable sheets 202 arranged on the first layer are staggered with the plurality of cavitator disc face retractable sheets 202 arranged on the second layer.

Figure 7:
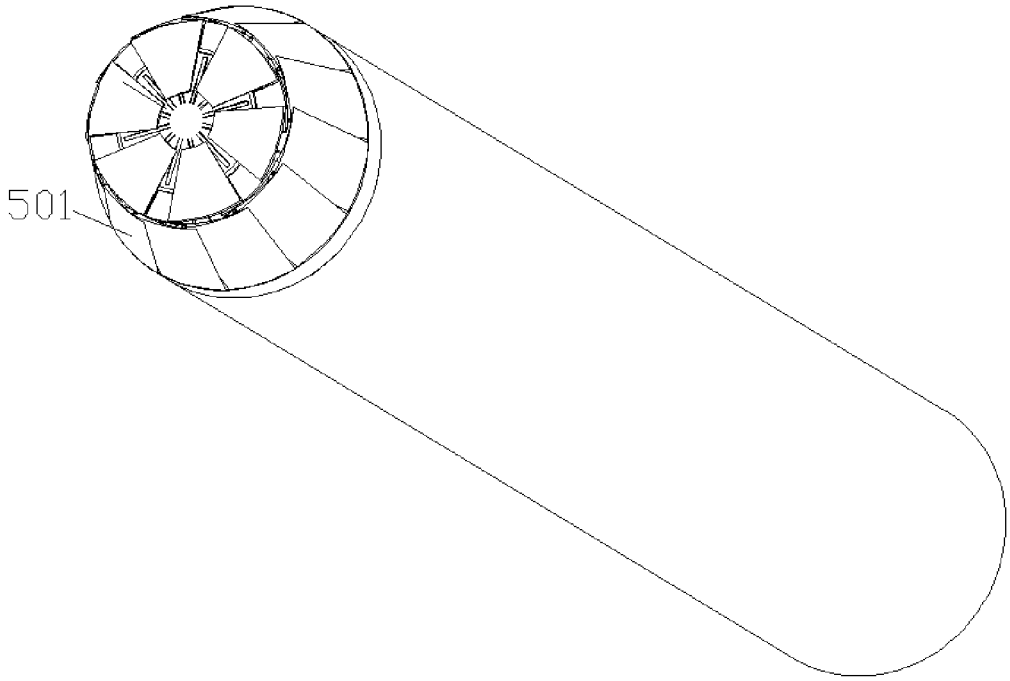
FIG. 7 is a schematic diagram of a cavitator when the retractable sheets contract according to an embodiment of the present invention.
Figure 8:
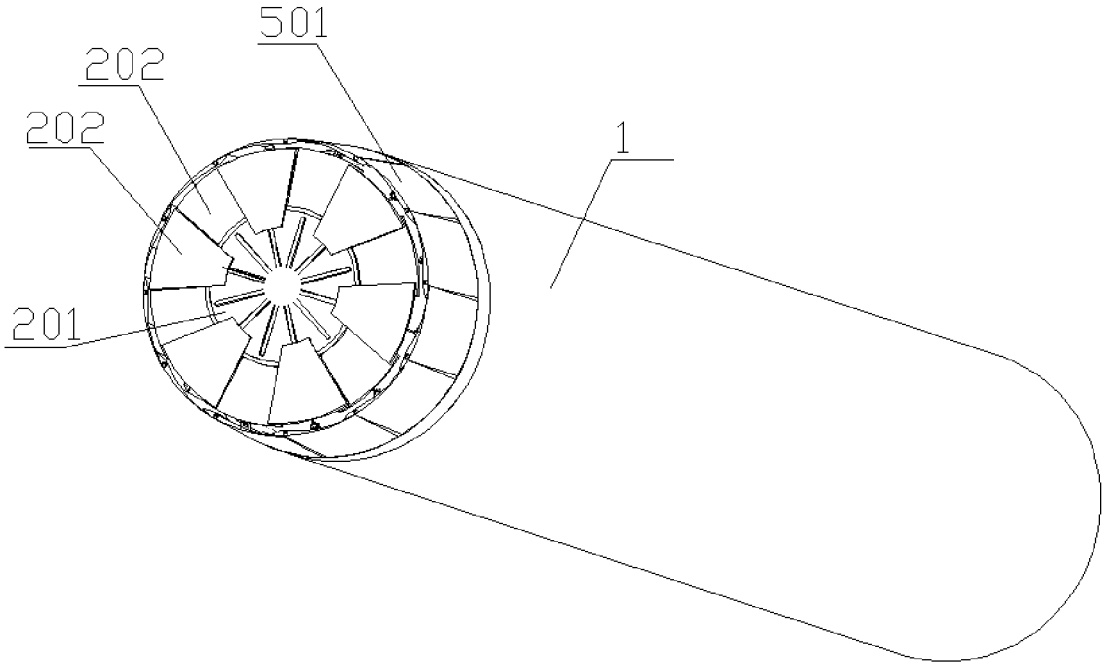
FIG. 8 is a schematic diagram of a cavitator when the retractable sheets expand according to an embodiment of the present invention.
Figure 9:
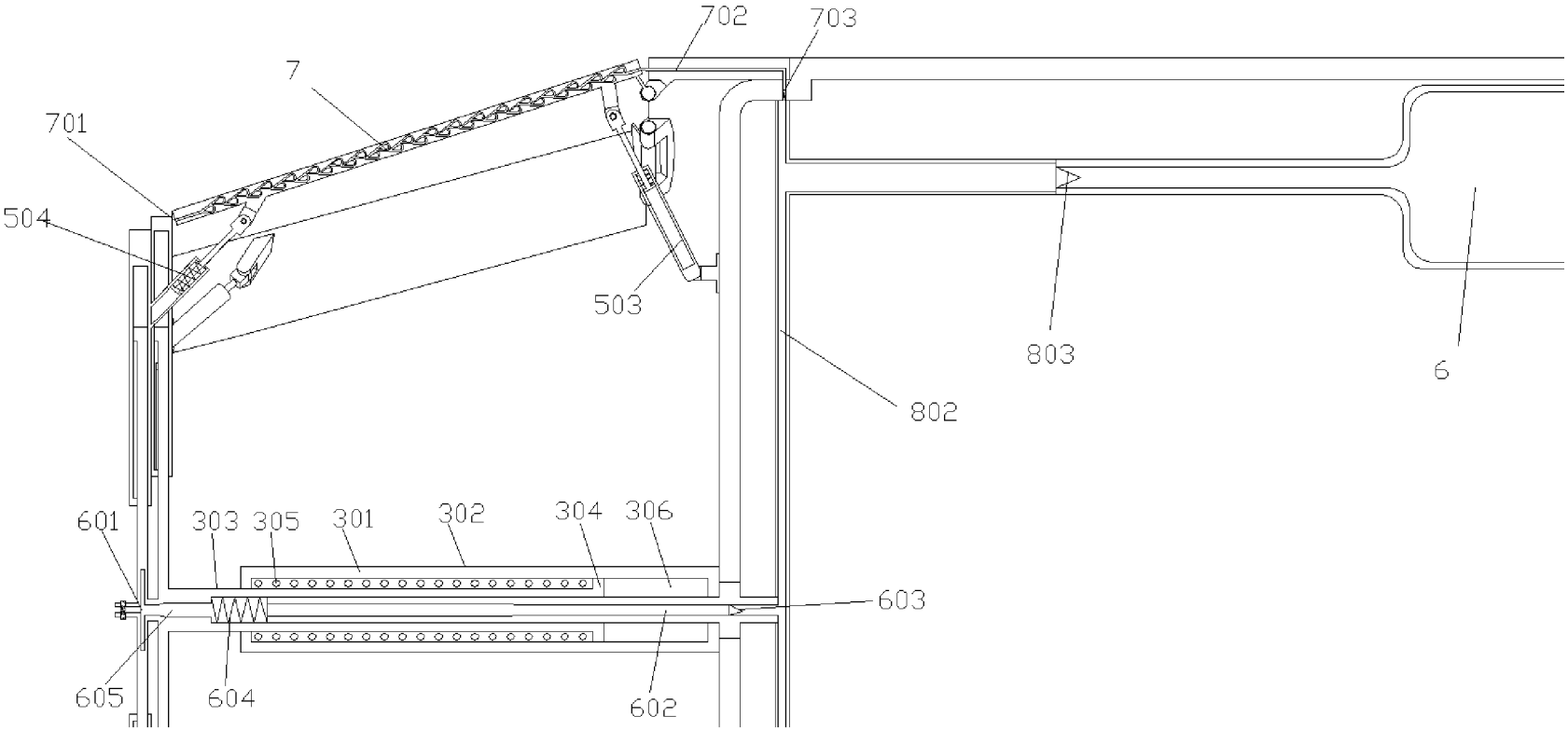
FIG. 9 is a schematic diagram of a damper and a first vent pipeline system according to an embodiment of the present invention.

As shown in FIGS. 7 to 9, the buffer driving mechanism 5 includes a plurality of airfoil adjusting sheets 501. The number of the airfoil adjusting sheets is matched with the number of the cavitator disc face retractable sheets 202, and the airfoil adjusting sheets are uniformly distributed around the axis of the cavitator body 201. Each the airfoil adjusting sheet 501 corresponds to one cavitator disc face retractable sheet 202. A rear end of each the airfoil adjusting sheet 501 is hinged with an outer edge of the head of the underwater vehicle 1 by means of the side faring 502 disposed at the outer edge of the head of the underwater vehicle 1 (that is, the side fairing 502 shaped as cylindrical is connected to the head of the underwater vehicle 1, and the rear end of the airfoil adjusting sheet 501 is hinged with the front end of the side fairing 502), and the siding faring 502 is connected to the underwater vehicle 1 through electromagnetic adsorption. A side of each the airfoil adjusting sheet 501 close to its rear end is hinged with one end of a first buffer retractable arm 503 and a side of that close to its front end is hinged with one end of a second buffer retractable arm 504. The other end of the first buffer retractable arm 503 is hinged with the outer circumference of the underwater vehicle 1, and the other end of the second buffer retractable arm 504 is fixedly connected to an upper part of a corresponding cavitator disc face retractable sheet 202 thereof. The first buffer retractable arm 503 and the second buffer retractable arm 504 are both obliquely disposed. The cross section of each the airfoil adjusting sheet 501 is airfoil shape, and two adjacent airfoil adjusting sheets are closely attached. Two-thirds of the profile of each the airfoil adjusting sheet 501 is a thinner streamlined shape, and the other one-third of the profile is a thick airfoil profile. An object of this design is to ensure that the adjacent airfoil adjusting sheets 501 can be closely attached with each other to minimize the clearance, so that the entire appearance of the underwater vehicle 1 mounted the head fairing device 4 can achieve the best streamline. When the airfoil adjusting sheet 501 contracts radially inward, the thicker end thereof can smoothly slide to the inner side of the thinner end of the adjacent airfoil adjusting sheet 501, ensuring a good overall appearance without being abrupt.

Figure 11:
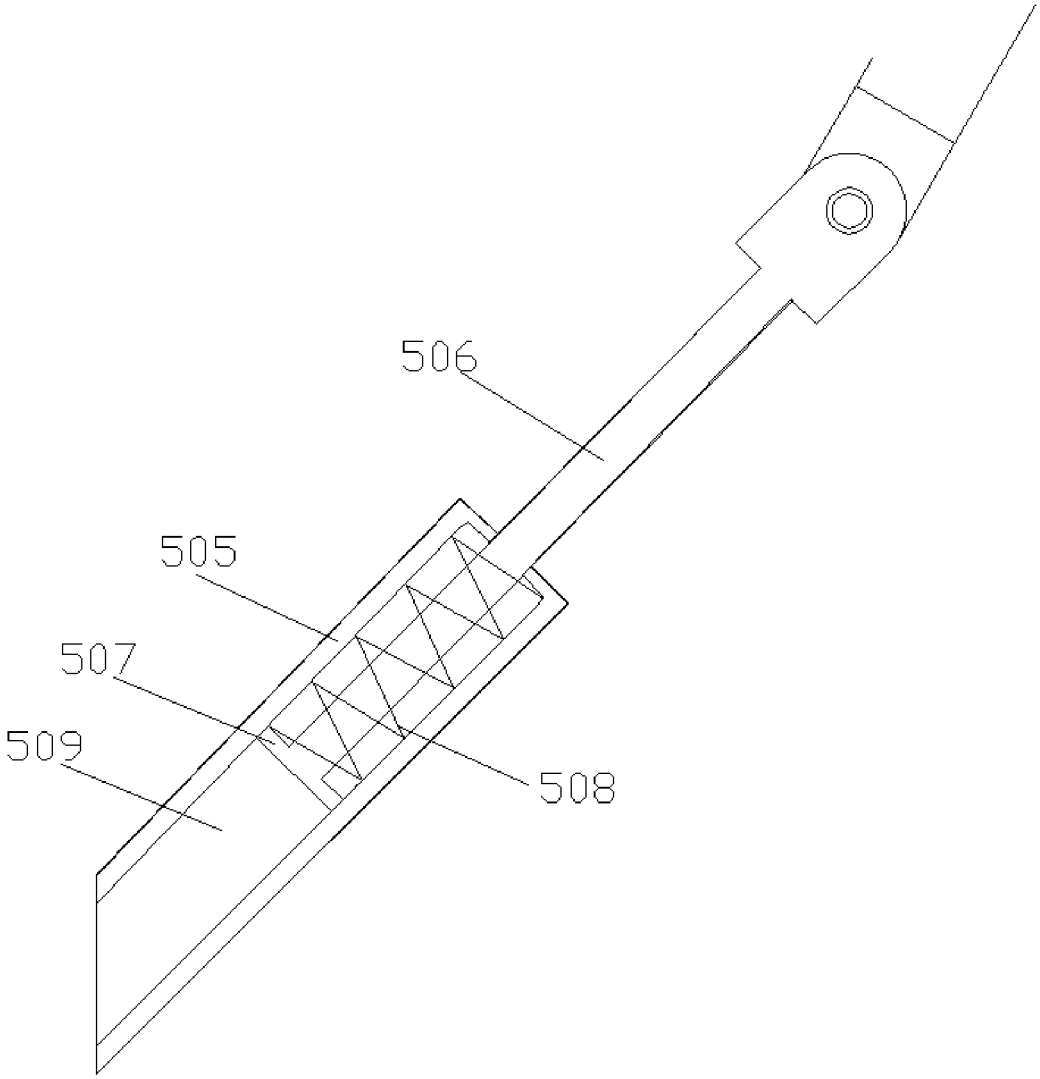
FIG. 11 is a structural schematic diagram of a second buffer retractable arm according to an embodiment of the present invention.

As shown in FIG. 11, in an embodiment, the first buffer retractable arm 503 and the second buffer retractable arm 504 have the same structure of a hydraulic telescopic rod type including a second outer sleeve 505. The second outer sleeve 505 is inside provided with a second piston rod 506 penetrating out of the second outer sleeve 505. An end, located in the second outer sleeve 505, of the second piston rod 506 is provided with a second piston 507 matched with the second outer sleeve 505. The parts of the second outer sleeve 505 located on both sides of the second piston 507 are respectively provided with a second hydraulic oil chamber 509 and a third pressure spring 508. The third pressure spring 508 is located close to one end where the second piston rod 506 passes through the second outer sleeve 505. The second outer sleeve 505 is inside provided with an oil storage chamber communicated with the second hydraulic oil chamber 509. Through a central control device inside the underwater vehicle 1, the hydraulic oil in the oil storage chamber of the second outer sleeve 505 enters the second hydraulic oil chamber 509 and pushes the second piston rod 506 to extend and the third pressure spring 508 is compressed at this time. On the contrary, the hydraulic oil in the second hydraulic oil chamber 509 returns to the second outer sleeve 505, and the second piston rod 506 contracts under the action of air pressure and the third pressure spring. By adjusting the first buffering retractable arm 503 and the second buffering retractable arm 504, the cavitator disc face retractable sheet 202 can achieve radial sliding. When the cavitator disc face retractable sheet 202 slides out, the area of the cavitator 2 is enlarged, while the area of the cavitator 2 is reduced when the cavitator disc face retractable sheet 202 slides in.

In the adjusting process, since the first buffer retractable arm 503 and the second buffer retractable arm 504 are obliquely connected to the airfoil adjusting sheet 501 and the cavitator disc face retractable sheet 202, the transmitted force is also an oblique force, resulting in a larger component force (which enables the retractable sheet to be perpendicular, in the radial direction of the cavitation disc, to the direction of the component force) in the water-entry direction (left and right directions in FIG. 14) during the transmission process. The component force will compress the cavitator disc face retractable sheet 202 to the right (compared to the water-entry direction) to compress and impact the cavitator body 201. Too-fast impact may cause the U-shaped limiting slots 204 and the sliding limiting protrusions 205 to be damaged and lose the function of adjusting the size of the cavitator. Therefore, hydraulic telescopic rod is adopted in an embodiment, which has a significant buffering effect on the transmission of motion, making the transmission of motion of the buffer driving mechanism 5 smoother and extending the service life of the device.

Figure 10:
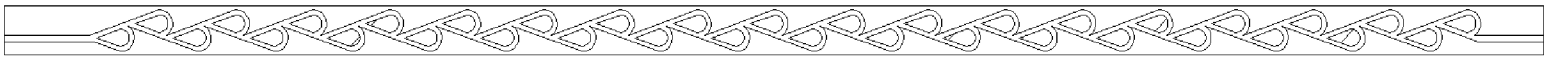
FIG. 10 is a structural schematic diagram of a gas acceleration hole according to an embodiment of the present invention.

As shown in FIGS. 9 and 10, each the airfoil adjusting sheet 501 is inside provided with a gas accelerating hole 7 which is Tesla valve hole. A front end of the gas acceleration hole 7 is communicated with a third jet port 701 disposed at a front end of the airfoil adjusting sheet 501, and a rear end of the gas acceleration hole 7 is communicated with a gas storage 6 disposed in the underwater vehicle by means of a hose 702 and a third vent valve 703. A through-type cylindrical channel is machined at the widest part of the edge of the airfoil adjusting sheet 501. The airfoil adjusting sheet 501 and the hinge connecting structure are both made of high-strength alloy. A cylindrical hollow column is inserted into the through-type cylindrical channel by means of adhesive bonding connection, and a gas acceleration hole 702 is disposed inside the hollow column. The hollow column is made of resin-based composite material by using a mold. The gas ejected from the third jet port 701 can be used not only to buffer and load reduction but also to form larger supercavity, which is beneficial to the formation of large supercavity.

Figure 14:
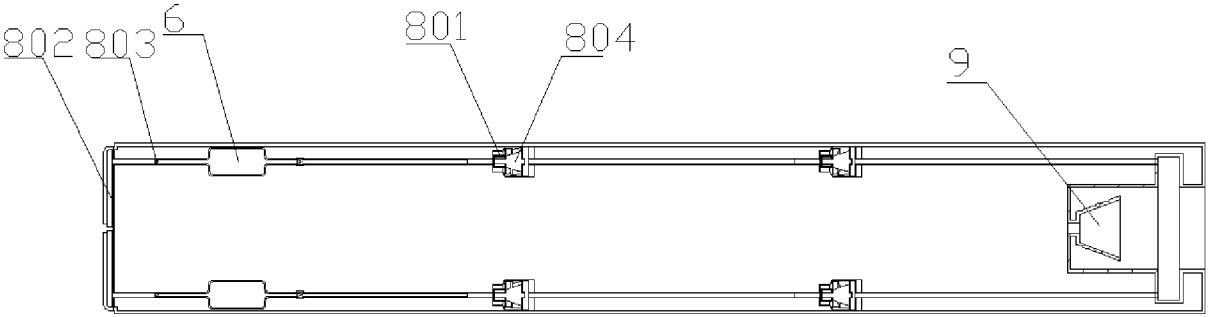
FIG. 14 is a structural schematic diagram of a tail gas collection device according to an embodiment of the present invention.

As shown in FIG. 14, a booster engine is disposed at a tail of the underwater vehicle 1, and a tail gas collection device 8 is disposed in the underwater vehicle 1. The tail gas collection device 8 includes a turbo-inspiratory driving device 801 which is disposed inside the turbo-inspiratory device protective cover 804. One end of the turbo-inspiratory driving device 801 is communicated with an exhaust end of the booster engine by means of a pipeline and the other end of the turbo-inspiratory driving device 801 is communicated with an inlet of the gas storage 6. A plurality of tail gas collection devices 8 may be used, and each the tail gas collection device 8 is provided with a plurality of turbo-inspiratory driving devices 801 in series. Each the tail gas collection device 8 is equipped with a gas storage 6. Outlets of the plurality of gas storages 6 are collected to the collecting pipeline 803 through the second vent valve 802. The turbo-inspiratory driving device in the present invention includes a turbofan, which absorbs tail gas by driving the turbofan to rotate.

As shown in FIG. 9, a front center of the cavitator body 201 is provided with a first jet port 601. The gas storage 6 is communicated with the first jet port 601 by means of a first vent pipeline system.

The damper 3 includes a first outer sleeve 302 which is provided with an oil storage chamber 301 and a first piston rod 303 inside. A front end of the first piston rod 303 penetrates out of the first outer sleeve 301 and is fixedly connected to the cavitator body 201, a rear end of the first piston rod 303 is provided with a first piston 304. A part between the first piston 304 and the front end of the first outer sleeve 302 is provided with a tension spring 305 sleeved on the first piston rod 303. A rear end of the first outer sleeve 302 is fixedly connected to the head of the underwater vehicle 1, and a part between the rear end of the first outer sleeve 302 and the first piston 304 forms a first hydraulic oil chamber 306 which is communicated with the oil storage chamber.

The first vent pipeline system includes a first vent pipe 602. A rear end of the first vent pipe 602 is communicated with the gas storage device 6. A first vent valve 603 is disposed in the first vent pipe 602. A front end of the first vent pipe 602 successively passes through a rear end center of the first outer sleeve 302 and a center of the first piston 304, penetrates into a first piston rod 303, and is in airtight sliding connection with inner walls of the first piston rod 303 and the first piston 304. An inside of a third piston rod 303 close to its front end is provided with a buffer air chamber. A rear end of the buffer gas chamber is communicated with the front end of the first vent pipe 602, and the buffer gas chamber is inside provided with a first pressure spring 604 with an axis coinciding with an axis of the first piston rod 303. An end face of the first vent pipe 602 abuts against the first pressure spring 604. A front end of the first piston rod 303 is provided with a through hole 605 communicated with the buffer gas chamber, and a front end of the through hole is communicated to the first jet port 601.

Figure 12:
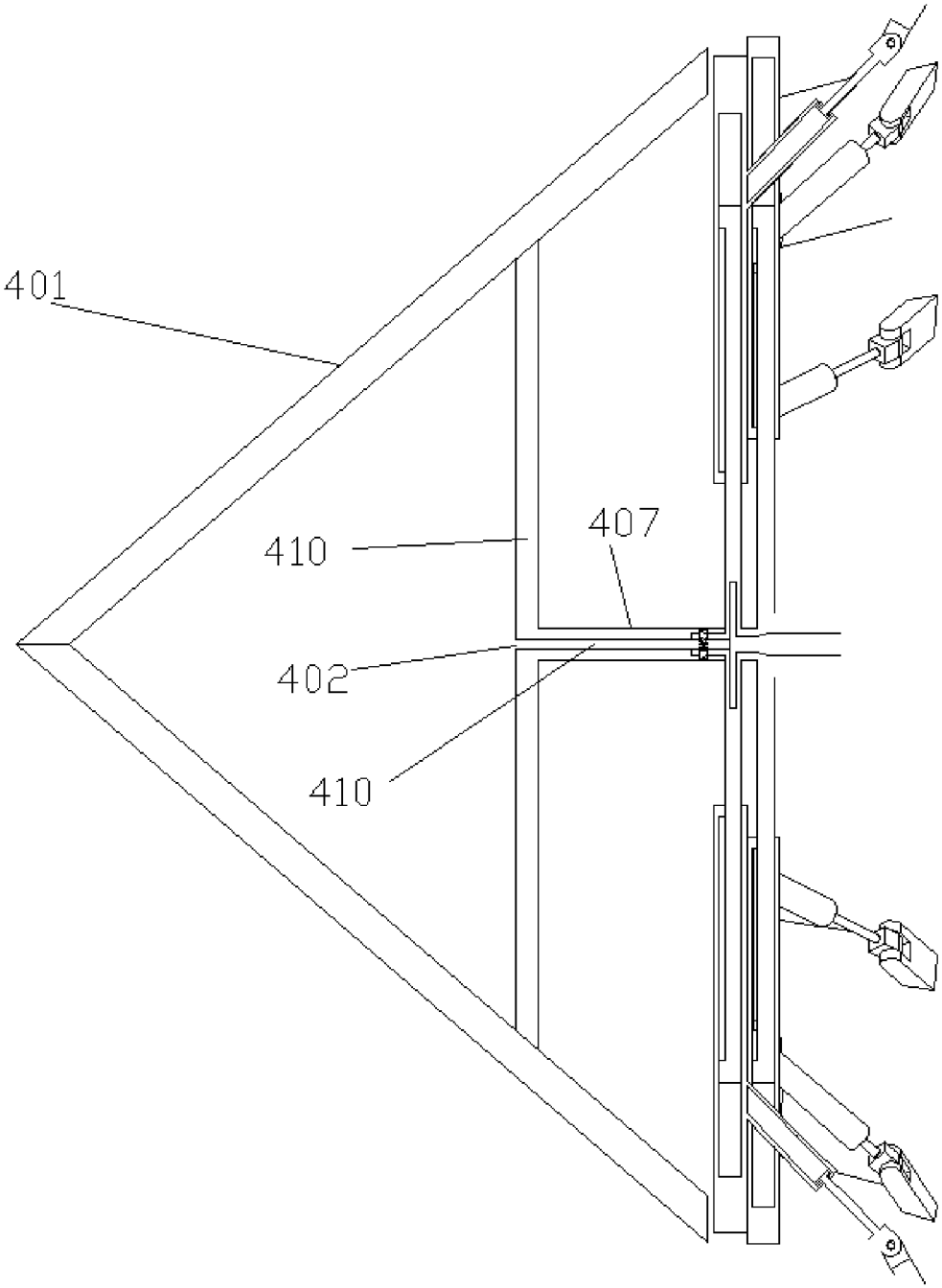
FIG. 12 is a structural schematic diagram of a head fairing device according to an embodiment of the present invention.
Figure 13:
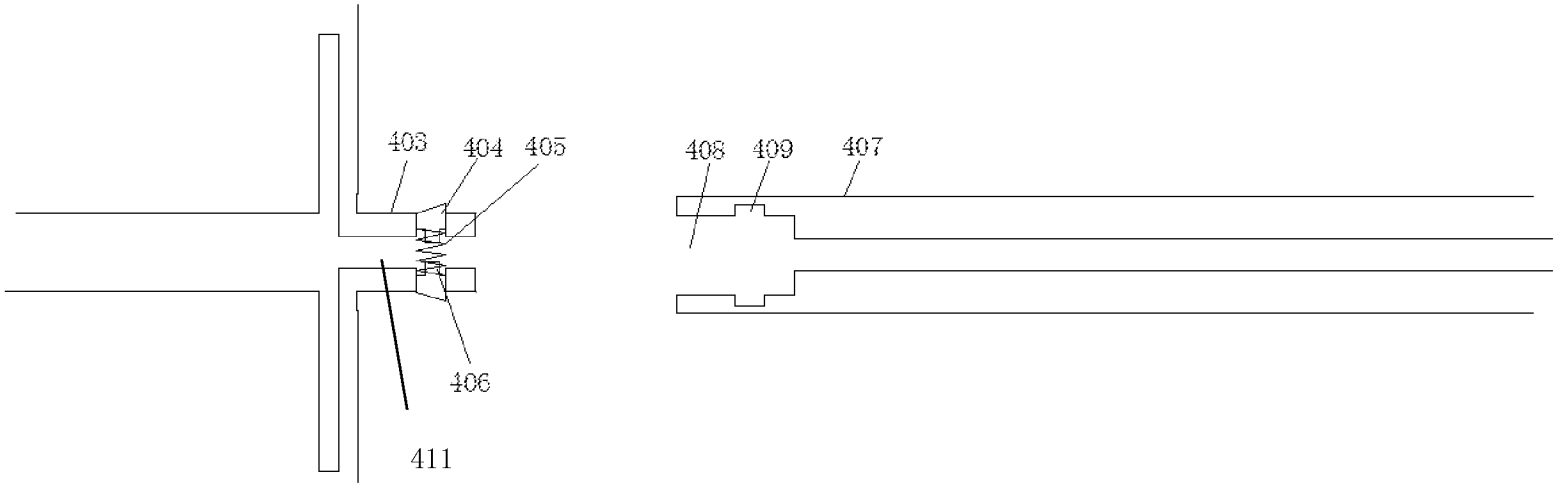
FIG. 13 is a structural schematic diagram of a connecting device (separated) according to an embodiment of the present invention.

As shown in FIGS. 12 and 13, the head fairing device 4 includes a head fairing 401 and a connecting device. The head fairing is detachably connected to a front end of the connecting device. The head fairing 401 is a conical shape or a pointed arch shape. The head fairing 401 is composed of a plurality of split shells, and every adjacent two split shells are connected by means of a connecting structure. A blasting device is disposed at the connecting structure, and a detonating device is disposed in the underwater vehicle for detonating the blasting device. After the detonating device detonates the blasting device, the fairing is separated along the connecting structures between the adjacent two split shells. The connecting structure is a "weak structure", which can be a strong adhesive to bond the adjacent two split shells together, or can be a thin plate to be fixedly connected to the adjacent two split shells. The connecting structure should have a certain strength, which can withstand the air resistance during high-speed flight in the air and maintain air tightness, and will not be deformed or damaged, and meanwhile, the connecting structure can be exploded and decomposed by the blasting device disposed inside, so that the head fairing 401 made of alloy is separated. A rear end of the connecting device can be detachably connected to the center of the cavitator body 201. The connecting device includes a connecting pipe 403 fixed at the front end of the first jet port 601. Two bolt mounting holes are symmetrically machined in a middle of the connecting pipe 403 up and down. Each of the two bolt mounting holes is mounted with a trapezoid fixing bolts 404. The two trapezoid fixing bolts are connected with each other by means of a second pressure spring 405. A side of the trapezoid fixing bolt 404 close to an axis of the connecting pipe 403 is fixed with an electromagnet 406. A rear end of a fairing fixing rod 407 is provided with a connecting groove 408 matched with the connecting pipe 403, and a slot 409 matched with the trapezoid fixing bolt 404 is machined on a wall of the connecting groove 408. A front end of the fairing fixing rod 407 is fixed with a connecting piece 410 which is fixedly connected to an inner wall of a rear end of the head fairing 401. The fairing fixing rod 407 is provided with a second vent pipe 411 inside. A rear end of the second vent pipe 411 is communicated with the connecting groove 408 and a front end of the second vent pipe 411 is communicated with a second ventage 402. When a front end of the connecting pipe 403 is inserted into the connecting groove 408, the trapezoid fixed bolt 404 is pushed into the slot 409 under the action of the second pressure spring 405, so that the connecting pipe 403 is reliably connected to the fairing fixing rod 407. When the fairing fixing rod 407 needs to be detached from the connecting pipe 403, the electromagnet 406 works to adsorb the two trapezoid fixing bolts 404, so that outer edges of the two trapezoid fixing bolts are lower than or coincides with the outer edge of the connecting pipe 403. At this time, a limiting fit between the trapezoid fixing bolts 404 and the slot 409 is released. The first vent valve 603 is opened, and high-pressure gas blows away the faring fixing rod 407 and the connecting piece 410, so that the fairing fixing rod 407 and the connecting piece 410 are separated from the cavitator body 201.

Figure 15:
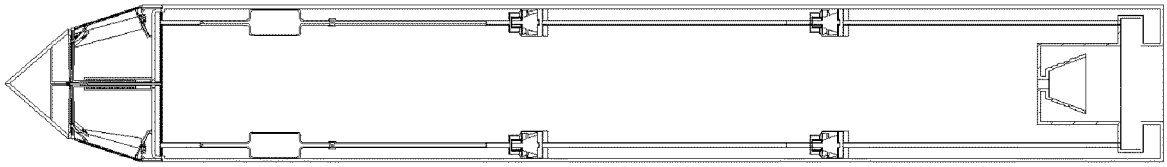
FIG. 15 is a schematic diagram of an underwater vehicle before water-entry according to an embodiment of the present invention.

In use state:

As shown in FIG. 15, when the underwater vehicle 1 flies in the air for a certain distance, in order to reduce the flight resistance, the cavitator disc face retractable sheet 202 radially contracts inward by the first buffer retractable arm 503 and the second buffer retractable arm 504, while the side of the airfoil adjusting sheet 501 close to the head faring 401 contracts inward, so that the whole vehicle presents a better streamline, thereby reducing the wind resistance during flight (as shown in FIG. 7).

Figure 16:
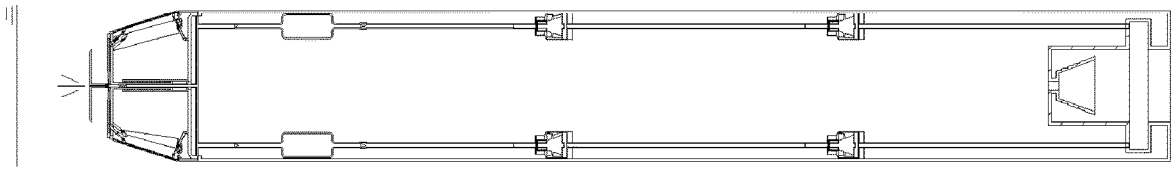
FIG. 16 is a schematic diagram of an underwater vehicle close to water surface according to an embodiment of the present invention, where the head fairing is separated and the second jet port performs air injection.

As shown in FIG. 16, when a sensor detects that the underwater vehicle 1 is at a certain distance from the water surface, the head fairing 401 is controlled to be decomposed, and the second vent valve 802 and the first vent valve 603 are controlled to be opened. At this time, the high-pressure gas stored in the gas storage 6 is sprayed out from the second jet port 402 to the water surface, so as to perform a first reverse air injection on the underwater vehicle 1, thereby reducing the flight speed to achieve load reduction.

Figure 17:
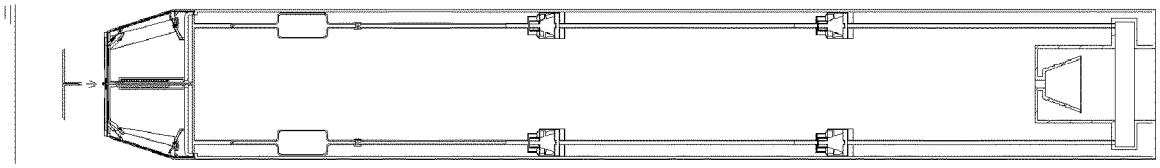
FIG. 17 is a schematic diagram of an underwater vehicle close to water surface according to an embodiment of the present invention, where a second jet port is separated.

As shown in FIG. 17, when the underwater vehicle 1 is further close to the water surface, the fairing fixing rod 407 and the connecting piece are separated from the cavitator body 201.

Figure 18:
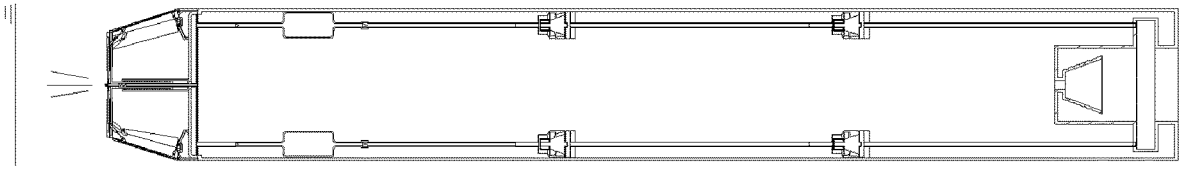
FIG. 18 is a schematic diagram of an underwater vehicle close to water surface according to an embodiment of the present invention, where a first jet port performs air injection.

As shown in FIG. 18, after the fairing fixing rod 407 and the connecting piece are separated from the cavitator body 201, the high-pressure gas is still sprayed out from the first jet port 601 to the water surface, so as to perform a secondary reverse air injection on the underwater vehicle 1 to reduce the flight speed and load.

Figure 19:
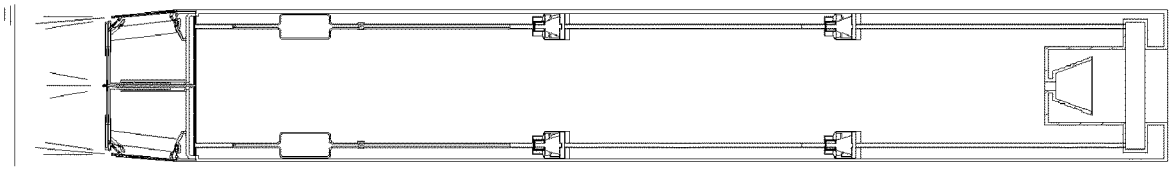
FIG. 19 is a schematic diagram of an underwater vehicle close to water surface according to an embodiment of the present invention, where a first jet port and a third jet port perform air injection at the same time.

As shown in FIG. 19, before the cavitator 2 impacts the water surface, by adjusting the first buffer retractable arm 503 and the second buffer retractable arm 504, the airfoil adjusting sheet 501 and the cavitator disc face retractable sheet 202 are driven to expand outwards, so as to enlarge the size of the cavitator 2 (as shown in FIG. 8). Meanwhile, the third vent valve 703 is opened, so that the high-pressure gas in the gas storage 6 enters the gas acceleration hole 7 through the hose 702 to be accelerated, the accelerated high-pressure gas is sprayed out from the third jet port 701, achieving a third reverse air injection on the underwater vehicle 1 to reduce the flight speed and load.

Figure 20:
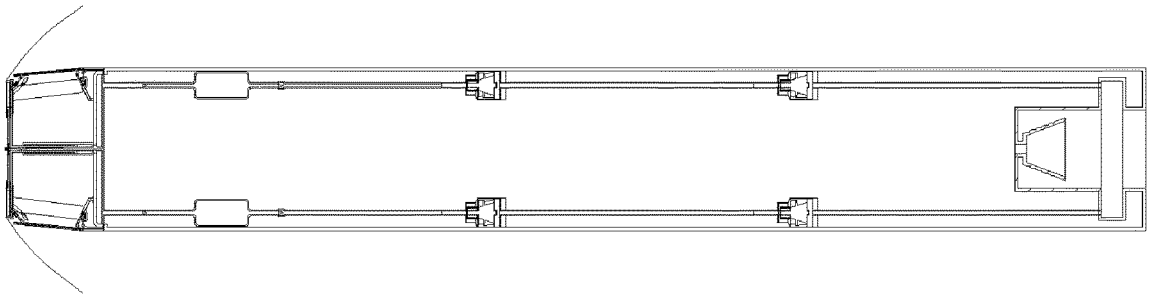
FIG. 20 is a schematic diagram of an underwater vehicle drives under a supercavity after water-entry according to an embodiment of the present invention.

As shown in FIG. 20, after the underwater vehicle 1 touches water, the first buffer retractable arm 503 and the second buffer retractable arm 504 can perform damping buffering, and meanwhile, the damper 3 can also play a role in buffering. The underwater vehicle 1 is subjected to supercavity navigation after entering water. During the supercavity navigation process, the size of the cavitator 2 may be adjusted as needed.

At last, it should be noted that the above various embodiments are merely intended to illustrate the technical solution of the present invention and not to limit the same; although the present invention has been described in detail with reference to the foregoing embodiments, it should be understood by those ordinary skilled in the art that the technical solutions described in the foregoing embodiments can be modified or equivalents can be substituted for some or all of the technical features thereof; and the modification or substitution does not make the essence of the corresponding technical solution deviate from the scope of the technical solution of each embodiment of the present invention.

The invention claimed is:

1. An adjustable cavitator structure having double layer retractable sheets, comprising a cavitator disposed at a head of an underwater vehicle, the cavitator comprises a cavitator body, a center of the cavitator body is connected to a center of the head of the underwater vehicle by means of a damper, a head fairing device is detachably connected to a front end of the cavitator body, wherein the cavitator body is of a double-layer structure comprising a first layer and a second layer, each of the first layer and the second layer is provided with a plurality of cavitator disc face retractable sheets which are uniformly distributed around an axis of the cavitator body and are slidably connected to the corresponding first layer or second layer, wherein the head of the underwater vehicle is provided with a buffer driving mechanism that drives the plurality of cavitator disc face retractable sheets to slide in a radial direction of the cavitator body, and the plurality of cavitator disc face retractable sheets and the cavitator body are spliced into a circle, wherein the buffer driving mechanism comprises a plurality of airfoil adjusting sheets, a number of the plurality of airfoil adjusting sheets is matched with a number of the plurality of cavitator disc face retractable sheets, the plurality of airfoil adjusting sheets are uniformly distributed around the axis of the cavitator body, each airfoil adjusting sheet corresponds to one of the plurality of cavitator disc face retractable sheet, a rear end of each airfoil adjusting sheet is hinged with an outer edge of the head of the underwater vehicle, a side of each airfoil adjusting sheet close to its rear end is hinged with one end of a first buffer retractable arm and a side of that close to its front end is hinged with one end of a second buffer retractable arm, the other end of the first buffer retractable arm is hinged with a front end face of the head of the underwater vehicle, the other end of the second buffer retractable arm is fixedly connected to an upper part of a corresponding cavitator disc face telescopic sheet thereof, a cross section of each airfoil adjusting sheet is airfoil shape, and two adjacent airfoil adjusting sheets are closely attached.

2. The adjustable cavitator structure having double layer retractable sheets according to claim 1, wherein each of the plurality of cavitator disc face retractable sheets is fan-shaped and is provided with a groove accommodating the first layer or the second layer, sliding U-shaped limiting slots extending in a radial direction are machined on each of the first layer and the second layer, sliding limiting protrusions matched with the sliding U-shaped limiting slots are machined on each of the plurality of cavitator disc face retractable sheets, and the plurality of cavitator disc face retractable sheets arranged on the first layer are staggered with the plurality of cavitator disc face retractable sheets arranged on the second layer.

3. The adjustable cavitator structure having double layer retractable sheets according to claim 1, wherein each airfoil adjusting sheet is inside provided with a gas acceleration hole which is Tesla valve hole, a front end of the gas acceleration hole is communicated with a third jet port disposed at a front end of the airfoil adjusting sheet, and a rear end of the gas acceleration hole is in communication with a gas storage disposed in the underwater vehicle by means of a hose and a third vent valve.

4. The adjustable cavitator structure having double layer retractable sheets according to claim 3, wherein a booster engine is disposed at a tail of the underwater vehicle, a tail gas collection device is disposed in the underwater vehicle, wherein tail gas collection device comprises a turbo-inspiratory driving device, a first end of the turbo-inspiratory driving device is in communication with an exhaust end of the booster engine by means of a pipeline and a second end of the turbo-inspiratory driving device is in communication with an inlet of the gas storage.

5. The adjustable cavitator structure having double layer retractable sheets according to claim 3, wherein a front center of the cavitator body is provided with a first jet port, and the gas storage is in communication with the first jet port by means of a first vent pipeline system.

6. The adjustable cavitator structure having double layer retractable sheets according to claim 5, wherein the damper comprises a first outer sleeve which is provided with an oil storage chamber and a first piston rod inside, a front end of the first piston rod extends out of the first outer sleeve and is fixedly connected to the cavitator body, a rear end of the first piston rod is provided with a first piston, a part between the first piston and the front end of the first outer sleeve is provided with a tension spring sleeved on the first piston rod, a rear end of the first outer sleeve is fixedly connected to the head of the underwater vehicle, and a part between the rear end of the first outer sleeve and the first piston forms a first hydraulic oil chamber which is in communication with the oil storage chamber.

7. The adjustable cavitator structure having double layer retractable sheets according to claim 6, wherein the first vent pipeline system comprises a first vent pipe, a rear end of the first vent pipe is in communication with the gas storage, a first vent valve is disposed in the first vent pipe, a front end of the first vent pipe successively passes through a rear end center of the first outer sleeve and a center of the first piston and penetrates into the first piston rod and is in airtight sliding connection with inner walls of the first piston rod and the first piston, an inside of a third piston rod close to its front end is provided with a buffer gas chamber, a rear end of the buffer gas chamber is in communication with the front end of the first vent pipe, the buffer gas chamber is provided inside with a first pressure spring with an axis coinciding with an axis of the first piston rod, an end face of the first vent pipe abuts against the first pressure spring, a front end of the first piston rod is provided with a through hole in communication with the buffer gas chamber, and a front end of the through hole is in communication with the first jet port.

8. The adjustable cavitator structure having double layer retractable sheets according to claim 5, wherein the head fairing device comprises a head fairing and a connecting device, the head fairing is detachably connected to a front end of the connecting device, a rear end of the connecting device is detachably connected to the center of the cavitator body, and a head end of the connecting device is provided with a second jet port in communication with the first jet port.

9. The adjustable cavitator structure having double layer retractable sheets according to claim 8, wherein the connecting device comprises a connecting pipe fixed at a front end of the first jet port, two bolt mounting holes are symmetrically machined in a middle of the connecting pipe up and down, each of the two bolt mounting holes is mounted with a trapezoid fixing bolt, the two trapezoid fixing bolt are connected with each other by means of a second pressing spring, and a side of the trapezoid fixing bolt close to an axis of the connecting pipe is fixed with an electromagnet;

a rear end of a fairing fixing rod is provided with a connecting groove matched with the connecting pipe, and a slot matched with the trapezoid fixing bolt is machined on a wall of the connecting groove;

a front end of the fairing fixing rod is fixed with a connecting piece which is fixedly connected to an inner wall of a rear end of the head fairing; and a second vent pipe is disposed in the faring fixing rod, a second ventage is disposed at the front end of the fairing fixing rod, and a front end of the second vent pipe is in communication with the second ventage and a rear end of the second vent pipe is in communication with the connecting groove.

* * * * *